US011413902B2

(12) United States Patent
Michenaud et al.

(10) Patent No.: US 11,413,902 B2
(45) Date of Patent: Aug. 16, 2022

(54) MULTI-FUNCTION WRITING INSTRUMENT COMPRISING A LEAD-HOLDER SYSTEM

(71) Applicant: SOCIETE BIC, Clichy (FR)

(72) Inventors: Etienne Michenaud, Montrouge (FR); Arnaud Bez, Garches (FR); Damien Dubourguier, Clemont de l'Oise (FR)

(73) Assignee: SOCIETE BIC, Clichy (FR)

( * ) Notice: Subject to any disclaimer, the term of this patent is extended or adjusted under 35 U.S.C. 154(b) by 19 days.

(21) Appl. No.: 16/955,476

(22) PCT Filed: Dec. 14, 2018

(86) PCT No.: PCT/FR2018/053291
§ 371 (c)(1),
(2) Date: Jun. 18, 2020

(87) PCT Pub. No.: WO2019/122628
PCT Pub. Date: Jun. 27, 2019

(65) Prior Publication Data

US 2021/0078353 A1 Mar. 18, 2021

(30) Foreign Application Priority Data

Dec. 20, 2017 (FR) ..... 1762636

(51) Int. Cl.
*B43K 21/22* (2006.01)
*B43K 21/00* (2006.01)
(Continued)

(52) U.S. Cl.
CPC ..... *B43K 21/22* (2013.01); *B43K 21/003* (2013.01); *B43K 21/006* (2013.01); *B43K 24/12* (2013.01); *B43K 27/02* (2013.01); *B43K 27/04* (2013.01)

(58) Field of Classification Search
CPC ..... B43K 21/22; B43K 21/006; B43K 27/02; B43K 27/04; B43K 24/12
See application file for complete search history.

(56) References Cited

U.S. PATENT DOCUMENTS 1,539,086 A 5/1925 Hofmann et al.
5,749,663 A * 5/1998 Takahashi ..... B43K 24/12 401/31

(Continued)

FOREIGN PATENT DOCUMENTS

DE 934516 C 10/1955
JP 2004181836 A 7/2004
WO 2014017258 A1 1/2014

OTHER PUBLICATIONS

International Search Report issued in International Application PCT/FR2018/053291, dated Mar. 28, 2019, with English translation (12 pages).

*Primary Examiner* — J C Jacyna
(74) *Attorney, Agent, or Firm* — Bookoff McAndrews, PLLC

(57) ABSTRACT

A multi-function writing instrument comprises a body extending in an axial direction, at least two writing elements arranged inside the body, each writing element comprising a writing head able to take up a retracted position in which the writing head is stowed in the body and a writing position in which the writing head protrudes from the body, one of the writing elements being a lead-holder system comprising a lead-holder mechanism and a lead container, the lead container comprising a side opening for inserting leads.

20 Claims, 4 Drawing Sheets

(51) Int. Cl.

| | |
|---|---|
| ***B43K 24/12*** | (2006.01) |
| ***B43K 27/02*** | (2006.01) |
| ***B43K 27/04*** | (2006.01) |

(56) References Cited

U.S. PATENT DOCUMENTS

| | | | | |
|---|---|---|---|---|
| 7,080,949 | B1 | 7/2006 | Yamamoto | |
| 2017/0144473 | A1* | 5/2017 | Branch | B43K 27/08 |
| 2020/0238748 | A1* | 7/2020 | Rolion | B43K 11/00 |
| 2020/0398607 | A1* | 12/2020 | Bez | B43K 21/003 |

* cited by examiner

MULTI-FUNCTION WRITING INSTRUMENT COMPRISING A LEAD-HOLDER SYSTEM

CROSS REFENCE TO RELATED APPLICATION(S)

This application is a National Stage Application of International Application No. PCT/FR2018/053291, filed on Dec. 14, 2018, now published as WO2019/122628 and which claims priority to French Application No. FR1762636, filed on Dec. 20, 2017.

TECHNOLOGICAL FIELD

The present disclosure relates to a multi-function writing instrument comprising a lead-holder system. It is recalled that a multi-function writing instrument is a writing instrument comprising a plurality of writing elements, and each writing element may be used selectively.

BACKGROUND

A multi-function writing instrument comprising a lead-holder system is known. The lead-holder system comprises, in a known manner, a lead-holder mechanism and a lead container.

However, when the lead container is empty, it is frequently difficult for a user to fill the container with new leads. This is because the user must either remove the lead-holder system from the multi-function writing instrument, which may prove complex and difficult to perform, or remove the lead-holder mechanism, which may prove difficult and which may lead to the loss of elements of the lead-holder mechanism, such as the spring of the lead-holder mechanism.

SUMMARY

The present disclosure aims to overcome these drawbacks, at least in part.

Accordingly, the present disclosure relates to a multi-function writing instrument comprising a body extending in an axial direction, at least two writing elements arranged inside the body, each writing element comprising a writing head able to take up a retracted position in which the writing head is retracted in the body and a writing position in which the writing head protrudes from the body, one of the writing elements being a lead-holder system comprising a lead-holder mechanism and a lead container, the lead container comprising a side opening for inserting leads.

The side opening in the lead container allows new leads to be inserted in the lead container. The user may thus insert new leads in the lead container without removing the lead-holder system from the multi-function writing instrument.

Hereinafter, unless indicated otherwise, "writing instrument" means "multi-function writing instrument."

Of course, the multi-function writing instrument may have two or more than two writing elements. Hereinafter, unless indicated otherwise, "writing element" means "the at least two writing elements."

Within the meaning of the present disclosure, a writing element is composed of any element comprising a writing head. Hereinafter, unless indicated otherwise, the writing head of any writing element is considered to have a writing tip, and the writing tip may be fixed (for example, a ball point) or movable (for example, a lead-holder lead) relative to the writing head. The writing tip may be for example a felt tip, a ballpoint or other tip, a graphite lead, a lead-holder lead, a crayon, any means that allows writing on a substrate or any end piece (active or passive) configured to cooperate with a screen, for example a capacitive or resistive screen. For example, if the writing element comprises a ballpoint, the writing element also comprises an ink reservoir.

For example, if the writing element comprises a fixed writing tip, for example a ball fitted to a writing head, the writing head being fitted to an ink reservoir, in the retracted position the writing tip is retracted in the body whilst in the writing position the writing tip extends outside the body. In another example, if the writing tip of the writing element is movable, such as, for example, a lead carried by a head of a lead-holder mechanism, in the retracted position the lead may be retracted within the lead holder, while the head of the lead holder may also be retracted within the body or may extend outside the body, or the lead may extend outside the head of the lead holder whilst the head is retracted within the body, and the lead does not protrude from the body. Of course, in the writing position this type of movable writing tip extends outside the body, while the head of the writing element may be outside or inside the body. In other words, for writing elements with a movable writing tip, an actuation device may serve only to cause the writing tip to come out of and/or return into the head of the writing element (for example to cause the lead of a lead-holder system to advance, and allow the lead to return into the lead-holder system when the jaws of the lead-holder mechanism are released and pressure is applied to the lead).

It will of course be understood that the body may be formed as a single part or may comprise a plurality of different parts. Within the present disclosure, the body comprises all the parts other than the writing element/s and the locking body. The body is of course hollow and configured to receive the writing element. The body therefore has an inside and an outside. The side window is a through-window arranged in a wall of the body opening radially. The body is provided with at least one window for each writing element. Thus, the button of each writing element is received in a separate window. In other words, there are at least as many windows as writing elements. However, it may be that a writing element is actuated by a rear button. There may therefore be a different number of windows and writing elements.

It will further be understood that a retraction mechanism of any known type also allows the writing element to move, by means of the button, between the retracted position and the writing position, and allows the writing element to be maintained in each of these positions. Of course, there are as many retraction mechanisms as writing elements, each mechanism being specific to a writing element. In other words, each writing element is provided with such a retraction mechanism.

The button is guided in the window for moving the writing element from the writing position to the retracted position and vice versa. For example, the window is substantially rectangular in shape, the long sides of the rectangular shape extending in an axial direction. In such an example, the button is guided axially by the long sides of the window. The short sides may limit the axial travel of the button, although not necessarily.

In some embodiments, the multi-function writing instrument comprises a lead retention element which may take up a position for retaining leads in the lead container and a position for inserting leads in the lead container through the side opening for inserting leads.

In the position for retaining leads in the lead container, the lead retention element reduces, or even eliminates the risk of a lead coming out of the lead container. In the position for inserting leads in the lead container, the side opening for inserting leads is at least partly unobstructed so that new leads can be inserted in the lead container.

In some embodiments, the retention element is configured to automatically return to the lead retention position.

Thus, with no intervention from a user, the retention element is in the position for retaining leads in the lead container.

In some embodiments, the retention element passes from the retention position to the insertion position by a movement in the axial direction of at least one axial end of the retention element relative to the lead container.

In some embodiments, the retention element passes from the retention position to the insertion position by rotating about the axial direction of the retention element relative to the lead container.

In some embodiments, the retention element is a sleeve arranged around the lead container.

In some embodiments, the sleeve comprises a lead insertion window.

In the position for inserting leads in the lead container, the lead insertion window of the sleeve is aligned with the side opening for inserting leads in the lead container.

In some embodiments, the retention element is a spring arranged around the lead container.

At rest, the spring is in the position for retaining leads in the lead container and when the spring is compressed, the spring is in the position for inserting leads in the lead container.

In some embodiments, the lead container is made of polypropylene (PP), polyethylene (PE), PA6 or PA12 aliphatic polyamide, thermoplastic copolyester (TPC), and/or thermoplastic copolyamide (TPA).

The lead container is made of a relatively flexible material. Thus, the lead container may be bent by the user when inserting leads so as to facilitate the insertion of leads in the lead container.

In some embodiments, the side opening for inserting leads has a length in the axial direction greater than or equal to 10 mm (millimeter), specifically greater than or equal to 15 mm, still more specifically greater than or equal to 20 mm and less than or equal to 40 mm, specifically less than or equal to 35 mm, still more specifically less than or equal to 30 mm.

In some embodiments, the body comprises a front portion and a rear portion, the front portion and the rear portion being movable in rotation relative to one another about the axial direction.

The user may separate the front portion from the rear portion so as to have access to the lead container.

In some embodiments, the front portion and the rear portion each comprise a spiral thread configured to cooperate with the spiral thread of the other portion.

The front portion is separated from the rear portion for example by unscrewing the front portion relative to the rear portion.

BRIEF DESCRIPTION OF THE DRAWINGS

Other characteristics and advantages of the object of the present disclosure will appear from the following description of embodiments, given as non-limiting examples, with reference to the accompanying drawings, in which.

In all the figures, common elements are identified by identical reference numerals.

DETAILED DESCRIPTION

Figure 1:
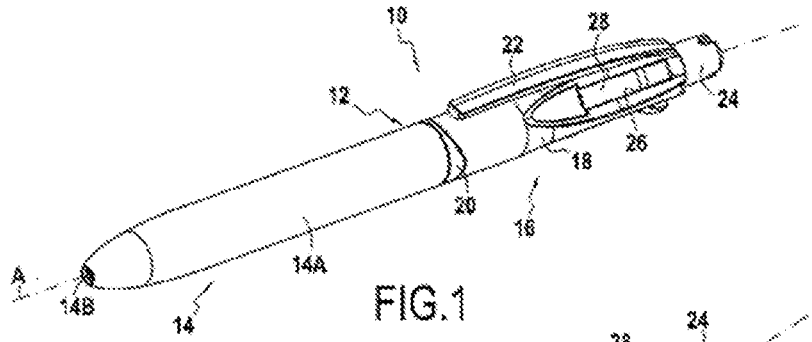
FIG. 1 is a perspective view of a multi-function writing instrument comprising a lead-holder system.
Figure 3:
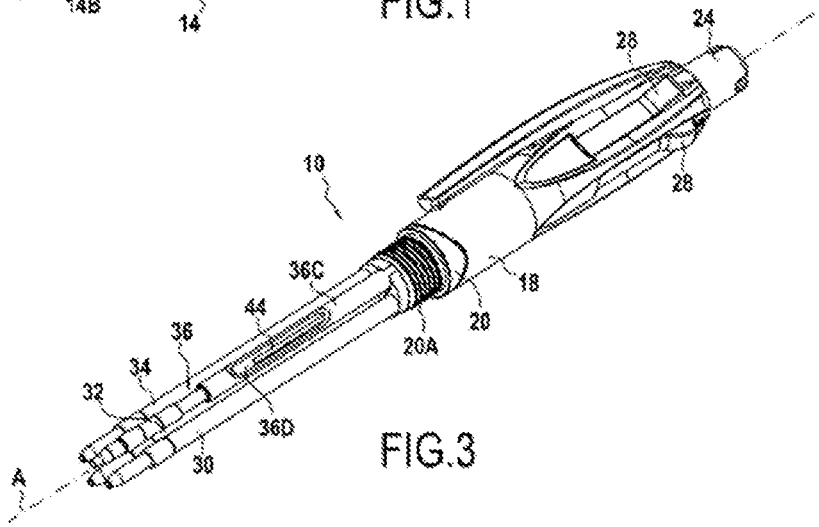
FIG. 3 is a perspective view of the multi-function writing instrument of FIG. 1, with no front barrel.
Figure 2:
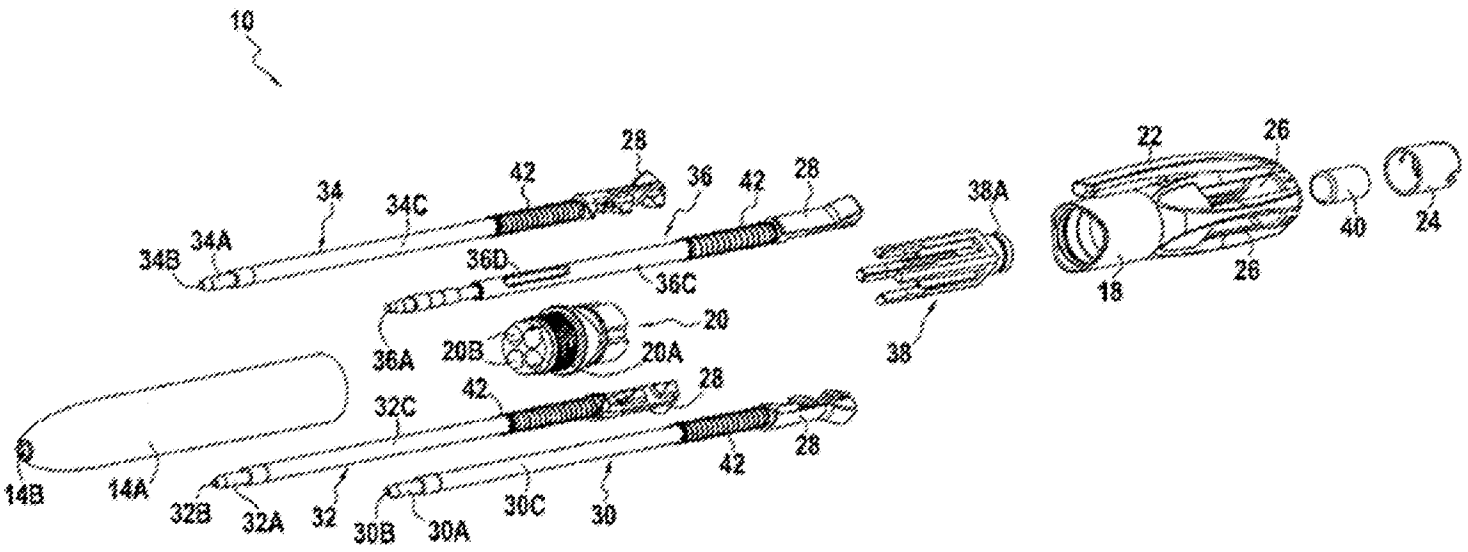
FIG. 2 is an exploded view of the multi-function writing instrument of FIG. 1 according to a first embodiment.

FIG. 1 shows a multi-function writing instrument 10 comprising a body 12 extending in an axial direction A. The body 12 comprises a front portion 14 and a rear portion 16. In the embodiment in FIG. 1, the front portion 14 is composed of a front barrel 14A and the rear portion 16 comprises a rear barrel 18 and an element 20 for connecting the rear barrel 18 to the front barrel 14A. The rear barrel 18 comprises a clip 22 and a cap 24. As shown in FIGS. 1 and 2, the rear barrel 18 also comprises side windows 26 in which buttons 28 are received for four writing elements 30, 32, 34, 36 arranged in the body 12.

As shown in FIG. 2, each writing element 30, 32, 34 comprises a writing head 30A, 32A, 34A, comprising a fixed writing tip 30B, 32B, 34B, such as a ball, and an ink reservoir 30C, 32C, 34C. Each writing element 30, 32, 34 also comprises a button 28 fitted to the ink reservoir. The writing element is a lead-holder system 36 which comprises a lead-holder mechanism 36A and a lead container 36C. The lead-holder mechanism 36A forms the writing head of the lead-holder system 36.

The front barrel 14A comprises an opening 14B through which the writing head may protrude.

The multi-function writing instrument 10 also comprises a locking element 38 and an eraser 40. The eraser 40 is protected by the cap 24. The cap 24 is therefore a protection cap 24 for the eraser 40.

The locking element 38 is inserted in the rear barrel 18 in such a way that the eraser receiving element 38A of the locking element 38 protrudes from the rear barrel 18. The locking element 38 comprises four fingers 38B extending in the axial direction A which, in cooperation with the windows 26, guide the buttons 28 of the writing elements 30, 32, 34, 36 when each writing element 30, 32, 34, 36 passes from the retracted position to the writing position and vice versa. To pass from the writing position to the retracted position, each writing element 30, 32, 34, 36 also comprises a return spring 42. The return spring 42 rests on the button 28 and on the connection element 20.

When the multi-function writing instrument 10 is assembled, the user may select a writing element by depressing the corresponding button 28. When a writing element passes from the retracted position to the writing position this causes all the other writing elements to move automatically to the retracted position, in particular with the aid of the return spring 42.

When the lead-holder system 36 is in the writing position, in other words when the lead-holder mechanism 36A protrudes from the front barrel 14A through the opening 14B, the lead-holder mechanism 36A may be actuated by pushing on the cap 24 of the multi-function writing instrument 10. Owing to the cap 24, when the lead-holder mechanism 36A is actuated, the user does not risk dirtying the eraser 40. The cap 24 and the locking element 38 form a portion of the actuation device of the lead-holder mechanism.

As shown in FIGS. 2 to 10, the lead container 36C comprises a side opening for inserting leads 36D.

The side opening for inserting leads 36D allows a user to insert new leads in the lead container 36C.

The side opening for inserting leads 36D may have a length L in the axial direction A greater than or equal to 10 mm, specifically greater than or equal to 15 mm, even more specifically greater than or equal to 20 mm and less than or equal to 40 mm, specifically less than or equal to 35 mm, still more specifically less than or equal to 30 mm.

For example, the length L of the side opening for inserting leads 36D may be 26 mm. The length L de 26 mm allows a standard lead 44 to be inserted in the lead container 36C without breaking the lead 44.

Figure 4:
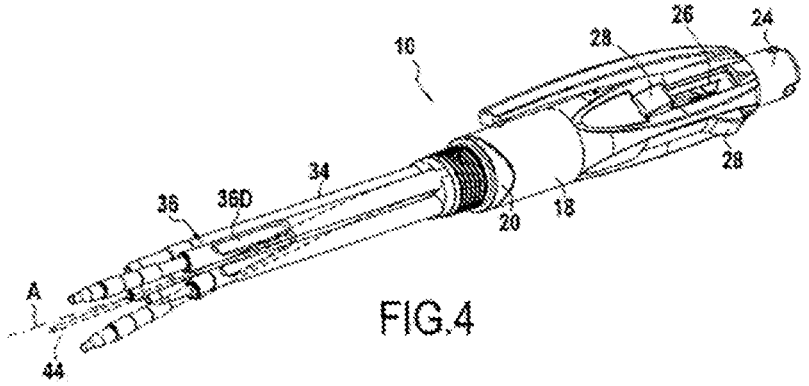
FIG. 4 is a view similar to the view in FIG. 3, in which the lead-holder system is in the writing position.

As shown in FIG. 4, the length L of the side opening for inserting leads 36D may be equal to 10 mm. The user is therefore advised to put the lead-holder system 36 in the writing position (solid line) and to bend the lead container 36C (dotted line) so as to be able to insert a lead 44 in the lead container 36C without breaking the lead 44.

If the user wishes to add leads to the lead container 36C, the user separates the front portion 14 from the rear portion 16 of the body 12 of the multi-function writing instrument 10. In the embodiment in the figures, the connection element 20 comprises a spiral thread 20A which cooperates with a complementary spiral thread in the front barrel 14A. Thus, to separate the front portion 14 from the rear portion 16, the user unscrews the front barrel 14A in order to have access in particular to the lead container 36C.

Hereinafter, the elements common to the various embodiments are identified by the same reference numerals.

In the embodiment in FIGS. 5 to 10, the multi-function writing instrument 10 comprises a lead retention element that may take up a position for retaining leads in the lead container 36C and a position for inserting leads in the lead container 36C through the side opening for inserting leads 36D.

In the embodiments in FIGS. 5 to 8, the retention element is a sleeve 46 arranged around the lead container 36C. In the embodiments thereof, the sleeve 46 is a cylindrical tube (a straight cylinder with a circular base) of which the internal diameter is dimensioned such that the sleeve 46 can be moved in translation in the axial direction A (embodiment in FIGS. 7 and 8) or in rotation about the axial direction A (embodiment in FIGS. 5 and 6) relative to the lead container 36C in response to an action by a user on the sleeve 46 and such that the sleeve 46 is maintained in the retention position around the lead container 36C if no action is performed by a user on the sleeve 46.

In the embodiments in FIGS. 5 to 8, advantageously, the sleeve 46 has a minimum external diameter greater than the diameter of the apertures 20B of the connection element 20 and a maximum external diameter that allows the front barrel 14A to be fitted to the rear portion 16 and not impede the passage of the other writing elements from the retracted position to the writing position, and vice versa. For example, the external diameter of the sleeve 46 is greater than or equal to 3.6 mm and less than or equal to 4.5 mm.

Figure 5:
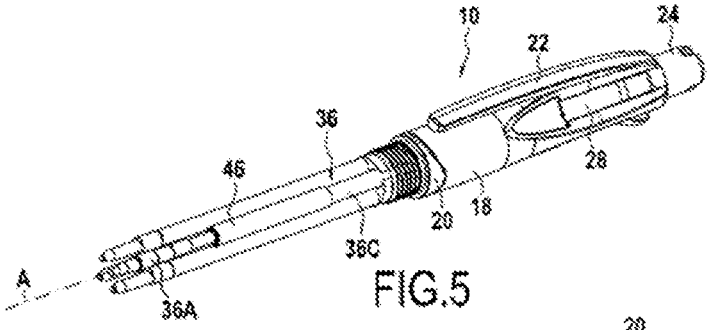
FIGS. 5 and 6 are views similar to the view in FIG. 3, according to a second embodiment.
Figure 6:
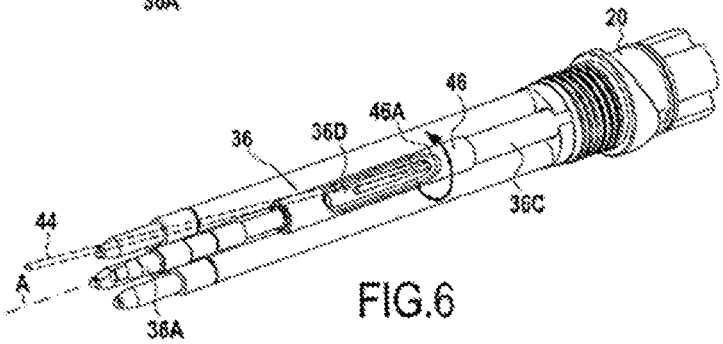

In the embodiment in FIGS. 5 and 6, the sleeve 46 comprises a lead insertion window 46A. When the lead insertion window 46A of the sleeve 46 is aligned with the lead insertion opening 36D of the lead container 36, the sleeve 46, and therefore the retention element, is in the position for inserting leads in the lead container 36. When the lead insertion window 46A of the sleeve 46 is not aligned with the lead insertion opening 36D of the lead container 36, the sleeve 46, and therefore the retention element, is in the position for retaining leads in the lead container 36.

It will be understood that the lead insertion window 46A of the sleeve 46 may not be completely aligned with the lead insertion opening 36D of the lead container 36 so that the sleeve 46, and therefore the retention element, is in the position for inserting leads in the lead container 36.

For example, in the embodiment in FIGS. 5 and 6, the length L of the lead insertion opening 36C is equal to 17 mm. In this case, in a similar manner to that shown in FIG. 4, the user bends the lead container 36C so as to insert a lead 44 without breaking the lead.

Figure 7:
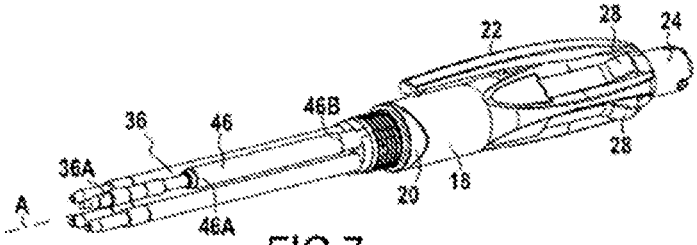
FIGS. 7 and 8 are views similar to the view in FIG. 3, according to a third embodiment.
Figure 8:
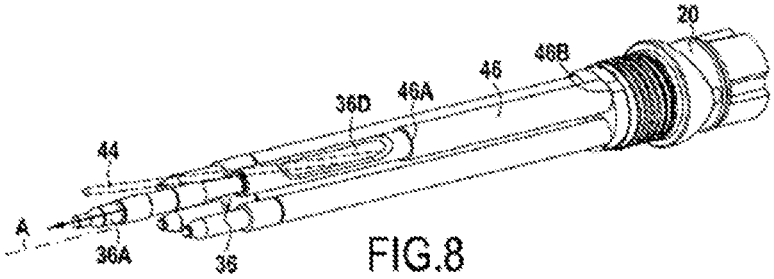

In the embodiment in FIGS. 7 and 8, the sleeve 46 and therefore the two axial ends 46A, 46B of the sleeve 46 are moved in the axial direction A relative to the lead container 36C. In FIG. 7, the sleeve 46 is shown in the position for retaining leads in the lead container 36C whereas in FIG. 8, the sleeve 46 is shown in the position for inserting leads in the lead container 36C.

As in the preceding embodiments, the lead container 36C may be bent to facilitate the insertion of a lead 44 in the lead container 36C without breaking the lead 44.

Figure 9:
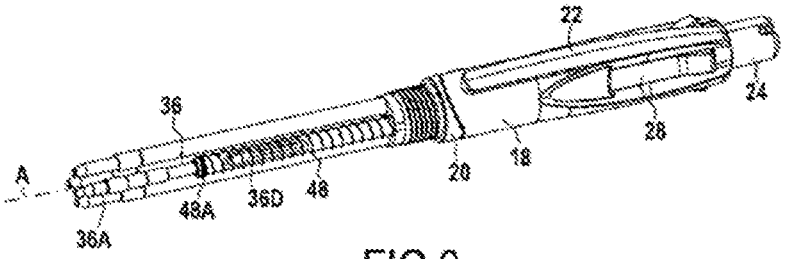
FIGS. 9 and 10 are views similar to the view in FIG. 3, according to a fourth embodiment.
Figure 10:
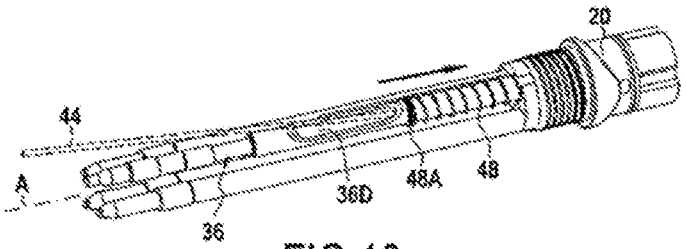

In the embodiment in FIGS. 9 and 10, the retention element is a spring 48 arranged around the lead container 36C. The spring 48 rests on the connection element 20. As shown in FIG. 9, the spring 48 is at rest and in the position for retaining leads in the lead container 36C. Although the lead insertion opening 36D can be seen through the spring 48, the spring 48 retains the leads 44 in the lead container 36C.

As shown in FIG. 10, the spring 48 is compressed, in other words an axial end 48A of the spring 48 is moved in the axial direction A relative to the lead container 36C to allow access to the lead insertion opening 36D of the lead container 36C.

When the user releases the spring 48, the spring 48 again takes up the rest position, in other words the lead retention position. The spring 48 is therefore returned to the lead retention position.

As in the preceding embodiments, the lead container 36C may be bent to facilitate the insertion of a lead 44 in the lead container 36C without breaking the lead 44.

Although the present disclosure has been described with reference to a specific embodiment, it is clear that various modifications and changes may be made to these examples without departing from the general scope as defined by the claims. Moreover, individual characteristics of the various embodiments referred to may be combined in additional embodiments. Consequently, the description and the drawings should be considered in an illustrative rather than a restrictive sense.

For example, the multi-function writing instrument 10 is presented with four writing elements. The multi-function writing instrument 10 could comprise a different number of writing elements, for example two or five. Moreover, the writing elements 30, 32, 34 may not comprise a writing tip comprising a ball. Each writing element could be of a different type from the other writing elements. It may also be envisaged that the multi-function writing instrument 10 could comprise a plurality of lead-holder systems 36, each lead-holder system 36 comprising in the respective lead container thereof leads of a different size and/or color. As mentioned earlier, the writing element may also be any means that allows writing on a substrate or any end piece (active or passive) configured to cooperate with a screen, for example a capacitive or resistive screen.

The invention claimed is:

1. A multi-function writing instrument comprising a body extending in an axial direction, the body including a front portion and a rear portion, at least two writing elements arranged inside the body, each writing element comprising a writing head able to take up a retracted position in which the writing head is retracted into the body and a writing position in which the writing head protrudes from the body, one of the writing elements being a lead-holder system comprising a lead-holder mechanism and a lead container, the lead container comprising a side opening for inserting leads, wherein the side opening is accessible for inserting leads into the lead container only after the front portion is separated from the rear portion.

2. A multi-function writing instrument according to claim 1, comprising a lead retention element which is configured to take up a position for retaining leads in the lead container and an insertion position for inserting leads in the lead container through the side opening for inserting leads.

3. A multi-function writing instrument according to claim 2, wherein the retention element is configured to pass from the retention position to the insertion position by a rotation about the axial direction of the retention element relative to the lead container.

4. A multi-function writing instrument according to claim 2, wherein the retention element is a sleeve arranged around the lead container.

5. A multi-function writing instrument according to claim 4, wherein the sleeve comprises a lead insertion window.

6. A multi-function writing instrument according to claim 1, wherein the side opening for inserting leads has a length in the axial direction greater than or equal to 20 mm and less than or equal to 30 mm.

7. A multi-function writing instrument according to claim 1, wherein the front portion and the rear portion are movable in rotation relative to one another about the axial direction.

8. A multi-function writing instrument comprising a body extending in an axial direction, two or more writing elements arranged inside the body, wherein the writing elements comprise a writing head configured to adopt a retracted position in which the writing head is stored inside the body and a writing position in which the writing head is projected outside the body, wherein one of the writing elements is a lead-holder system comprising a lead-holder mechanism and a lead container, the lead container comprising a lateral lead insertion opening, the writing instrument further comprising a lead retention element which is configured to take up a position for retaining leads in the lead container and an insertion position for inserting leads in the lead container through a side opening for inserting leads, wherein the retention element is a sleeve arranged around the lead container, and the sleeve is contained entirely within the body of the writing instrument.

9. A multi-function writing instrument according to claim 5, wherein the sleeve is configured to pass from the retention position to the insertion position by a rotation about the axial direction of the retention element relative to the lead container.

10. A multi-function writing instrument according to claim 6, comprising a lead retention element which is configured to take up a position for retaining leads in the lead container and an insertion position for inserting leads in the lead container through the side opening for inserting leads.

11. A multi-function writing instrument according to claim 10, wherein the retention element is configured to pass from the retention position to the insertion position by a rotation about the axial direction of the retention element relative to the lead container.

12. A multi-function writing instrument according to claim 10, wherein the retention element is a sleeve arranged around the lead container, and the sleeve is contained entirely within the body of the writing instrument.

13. A multi-function writing instrument according to claim 12, wherein the sleeve comprises a lead insertion window.

14. A multi-function writing instrument according to claim 13, wherein the sleeve is configured to pass from the retention position to the insertion position by a rotation about the axial direction of the retention element relative to the lead container.

15. A multi-function writing instrument according to claim 10, wherein the front portion and the rear portion being movable in rotation relative to one another about the axial direction.

16. A multi-function writing instrument according to claim 11, wherein the front portion and the rear portion are movable in rotation relative to one another about the axial direction.

17. A multi-function writing instrument according to claim 12, wherein the front portion and the rear portion are movable in rotation relative to one another about the axial direction.

18. A multi-function writing instrument according to claim 13, wherein the front portion and the rear portion are movable in rotation relative to one another about the axial direction.

19. A multi-function writing instrument according to claim 8, wherein the body comprises a front portion and a rear portion, and the sleeve is accessible for loading leads into the lead container only when the front portion and rear portion of the body are separated from one another.

20. A multi-function writing instrument according to claim 19, wherein the sleeve is configured to pass from the retention position to the insertion position by a rotation about the axial direction of the retention element relative to the lead container, wherein the sleeve comprises a lead insertion window, wherein leads are insertable through the side opening only when the lead insertion window of the sleeve at least partially radially aligns with the side opening.

* * * * *